US006069118A

United States Patent [19]

Hinkel et al.

[11] Patent Number: 6,069,118

[45] Date of Patent: May 30, 2000

[54] ENHANCING FLUID REMOVAL FROM FRACTURES DELIBERATELY INTRODUCED INTO THE SUBSURFACE

[75] Inventors: Jerald J. Hinkel, Houston; Kevin W. England, Longview, both of Tex.

[73] Assignee: Schlumberger Technology Corporation, Sugar Land, Tex.

[21] Appl. No.: 09/087,286

[22] Filed: May 28, 1998

[51] Int. Cl.[7] ..... C09K 3/00; E21B 43/26

[52] U.S. Cl. ..... 507/277; 507/209; 507/214; 507/233; 507/261; 507/266; 507/271; 507/922; 507/924; 166/308

[58] Field of Search ..... 507/136, 145, 507/110, 903, 261, 922, 924, 277, 209, 271, 214, 233, 266; 166/308

[56] References Cited

U.S. PATENT DOCUMENTS

| | | | |
|---|---|---|---|
| 4,830,765 | 5/1989 | Perricone et al. | 507/136 |
| 4,851,394 | 7/1989 | Kubodera . | |
| 5,041,225 | 8/1991 | Eddie . | |
| 5,141,920 | 8/1992 | Bland et al. | 507/136 |
| 5,260,269 | 11/1993 | Hale et al. | 507/136 |
| 5,501,276 | 3/1996 | Weaver et al. . | |
| 5,635,458 | 6/1997 | Lee et al. | 507/140 |
| 5,686,396 | 11/1997 | Hale et al. | 507/136 |

OTHER PUBLICATIONS

SPE 39920 "Optimization of Fracture Cleanup Using Flowback Analysis", Willberg, et al, Apr., 1998.

SPE 38619 "The Effect of Yield Stress on Fracture Fluid Cleanup", May, et al, Oct., 1997.

SPE 37263 "Physico–Chemical Stabilization of Shales", van Oort, et al, Feb., 1997.

SPE 30499 "Manipulation of Coupled Osmotic Flows for Stabilisation of Shales Exposed to Water–Based Drilling Fluids", van Oort, et al, Oct., 1995.

Unalmiser, et al, "Engineering Core Analysis", Journal of Petroleum Technology (Apr. 1998) pp. 106–114.

Simpson, Jay. "Studies of the Effects of Drilling Fluid/Shale Interactions on Borehole Instability", GasTIPS (Spring 1997) pp. 30–36.

Hanshaw, et al. "Osmotic Equilibrium and Overthrust Faulting", Short Notes, Geological Society of America Bulletin, v. 76, p. 1379, 1386, Dec. 1965, pp. 1379–1385.

Meschia, et al. "Experimental Study of Osmosis Through a Colloidion Membrane", Journal of General Physiology., 1958, vol. 42, No. 2, pp. 429–444.

Kimura, et al. "Analysis of Data in Reverse Osmosis with Porous Cellulose Acetate Membranes", AIChE Journal, vol. 13, No. 3, pp. 497–503., (1967).

Durbin, Richard P. "Osmotic Flow of Water Across Permeable Cellulose Membrances", Journal of General Physiology, 1960, vol. 44, pp. 315–326.

Gregor et al. "Synthetic–Membrane Technology", pp. 112–128, no date available.

*Primary Examiner*—Philip Tucker

*Attorney, Agent, or Firm*—Douglas Y'Barbo; Robin C. Nava

[57] ABSTRACT

The present Invention relates to hydrocarbon well stimulation, and more particularly to methods and compositions to remove (or more generally to transfer) fluid introduced into a subsurface fracture, in which the methods involve creating then exploiting chemical potential gradients at the fracture face to induce fluid flow from the fracture into the formation; the methods and compositions involve creating, or relying upon an intrisic or previously created, a selectively permeable membrane that is permeable to water but that does not allow solutes to pass through.

11 Claims, 6 Drawing Sheets

ENHANCING FLUID REMOVAL FROM FRACTURES DELIBERATELY INTRODUCED INTO THE SUBSURFACE

BACKGROUND OF THE INVENTION

1. Technical Field of the Invention

The present Invention relates to hydrocarbon well stimulation, and more particularly to methods and compositions to remove (and more generally to transfer) fluid deliberately introduced into a subsurface fracture zone, in which the methods and compositions involve creating then exploiting chemical potential gradients at the fracture face to systematically induce fluid flow from the fracture into the formation (or from the formation into the fracture).

2. The Prior Art

The present Invention relates generally to hydrocarbon (petroleum and natural gas) production from wells drilled in the earth. Obviously, it is desirable to maximize both the rate of flow and the overall capacity of hydrocarbon from the subsurface formation to the surface, where it can be recovered. One set of techniques to do this is referred to as stimulation techniques, and one such technique, "hydraulic fracturing," is the subject of the present Invention. The rate of flow, or "production" of hydrocarbon from a geologic formation is naturally dependent on numerous factors. One of these factors is the radius of the borehole; as the bore radius increases, the production rate increases, everything else being equal. Another, related to the first, is the flowpaths available to the migrating hydrocarbon.

Drilling a hole in the subsurface is expensive—which limits the number of wells that can be economically drilled—and this expense only increases as the size of the hole increases. Additionally, a larger hole creates greater instability to the geologic formation, thus increasing the chances that the formation will shift around the wellbore and therefore damage the wellbore (and at worse collapse). So, while a larger borehole will, in theory, increase hydrocarbon production, it is impractical, and there is a significant downside. Yet, a fracture or large crack within the producing zone of the geologic formation, originating from and radiating out from the wellbore, can actually increase the "effective" (as opposed to "actual") bore radius, thus, the well behaves (in terms of production rate) as if the entire bore radius were much larger.

Fracturing (generally speaking, there are two types, acid fracturing and hydraulic, the latter of primary interest here) thus refers to methods used to stimulate the production of fluids resident in the subsurface, e.g., oil, natural gas, and brines. Hydraulic fracturing involves literally breaking or fracturing a portion of the surrounding strata, by injecting a specialized fluid into the wellbore directed at the face of the geologic formation at pressures sufficient to initiate or extend a fracture in the formation. More particularly, a fluid is injected through a wellbore; the fluid exits through holes (perforations in the well casing) and is directed against the face of the formation at a pressure and flow rate sufficient to overcome the overburden pressure and to initiate and/or extend a fracture(s) into the formation. Actually, what is created by this process is not necessarily a single fracture, but a fracture zone, i.e., a zone having multiple fractures, or cracks in the formation, through which hydrocarbon can more easily flow to the wellbore.

In practice, fracturing a well is a highly complex operation performed with the precise and exquisite orchestration of over a dozen trucks, roughly the same number of highly skilled engineers and technicians, and powerful integrated computers monitoring pumping rates, downhole pressure transducers, etc. During a typical fracturing job, over 350,000 pounds of fluid will be pumped at extraordinary pressures down a well to a pinpoint location often thousands of feet below the surface. Moreover, during the fracturing job, constant iterations of fluid level, pumping rates, pumping times are performed, in order to maximize the fracture zone, and minimize the damage to the formation.

A typical fracture zone is shown in context, in FIG. 1. The actual wellbore—or hole in the earth into which pipe is placed through which the hydrocarbon flows up from the hydrocarbon-bearing formation to the surface—is shown at 10, and the entire fracture zone is shown at 20. The vertical extent of the hydrocarbon-producing zone is roughly coextensive with the fracture-zone height (by design). These two coextensive zones are shown bounded by 22 and 24. The fracture is created in the producing zone of interest (rather than another geologic zone) because holes or perforations, 26–36, are deliberately created in the well casing beforehand; thus the fracturing fluid flows down (vertically) the wellbore and exits through the perforations. Again, this zone does not necessarily represent a singular void in the subterranean formation, but rather represents a zone of multiple voids of varying dimensions.

Thus, once the well has been drilled, fractures are often deliberately introduced in the formation, as a means of stimulating production, by increasing the effective bore radius. Clearly then, the longer the fracture, the greater the effective bore radius. More precisely, wells that have been hydraulically fractured exhibit both radial flow around the wellbore (conventional) and linear flow from the hydrocarbon-bearing formation to the fracture, and further linear flow along the fracture to the wellbore. Therefore, hydraulic fracturing is a common means to stimulate hydrocarbon production in low permeability formations. In addition, fracturing has also been used to stimulate production in high permeability formations (50 to >500 millidarcy). Obviously, if fracturing is desirable in a particular instance, then it is also desirable, generally speaking, to create as large (i.e., long) a fracture zone as possible—e.g., a larger fracture means an enlarged flowpath from the hydrocarbon migrating towards the wellbore and to the surface.

Yet many wells behave as though the fracture length were much shorter because the fracture is contaminated with fracturing fluid (i.e., more particularly, the fluid used to deliver the proppant as well as a fluid used to create the fracture, both of which shall be discussed below). The most difficult portion of the fluid to recover is that retained on the fracture tip—i.e. the distant-most portion of the fracture. Thus, the result of stagnant fracturing fluid in the fracture naturally diminishes the recovery of hydrocarbons. The reasons for this are both simple and complex. Most simply, the presence of fluid in the fracture acts as a barrier to the migration of hydrocarbon from the formation into the fracture. More precisely, the (aqueous-based fluid) saturates the pore spaces of the fracture face, preventing the migration of hydrocarbon into the same pore spaces, i.e., that fluid-saturated zone has zero permeability to hydrocarbon.

Indeed, diminished effective fracture length caused by stagnant fluid retained in the fracture tip is perhaps the most significant variables limiting hydrocarbon production (both rate and capacity) from a given well. This is particularly true for low permeability reservoirs (approx. <50 millidarcys). The significance of this drag on well productivity is evidenced by the empirical observation well known to the skilled reservoir engineer that effective fracture lengths (the true fracture length minus the distal portion of the fracture saturated with fracturing fluid) are generally about one half of the true fracture length. To achieve an increase in effective fracture length—so that it approaches the true fracture length—therefore involves removing stagnant fracturing fluid from the fracture.

The deliberate removal of fracturing fluid from the fracture is known as "clean-up," i.e., this term refers to recovering the fluid once the proppant has been delivered to the fracture. The current state-of-the-art method for fracture clean-up involves very simply, pumping the fluid out of the fracture—thus the fracture fluid residing in the tip must traverse the entire length of the fracture (and up the wellbore) to be removed from the fracture. The present Application is directed to an improved method—and compositions to execute that method—for clean-up of the fracture.

The most difficult task related to fracture clean-up is to remove the stagnant fracture fluid retained in the fracture tip (i.e., farthest from the wellbore). Often, a portion of the fracture may be hydraulically isolated, or "cut-off" so that the hydrocarbon flowing from the formation into the fracture completely bypasses this tip region, as shown in FIG. 2. Ground level is shown at 5. The direction of hydrocarbon flow is shown at 38. Thus hydrocarbon flows—aided by the presence of the newly created fracture from the formation 40 into the fracture 42—traverses the fracture until it gets to wellbore 10 where it is recovered at the surface. A similar flowpath is shown at 44. These flowpaths can define two regions 46, a producing region, and 48, a nonproducing region at the fracture tip that is hydraulically isolated from the rest of the fracture since no hydrocarbon flows through this portion of the fracture, thus no pressure gradient exists. This phenomenon (in addition to others) ensures that the stagnant fracture fluid will remain in the fracture tip rather than being displaced by producing hydrocarbon, which can occur in the region shown at 46.

Generally speaking, creating a fracture in a hydrocarbon-bearing formation requires a complex suite of materials. Generally speaking, four crucial components are required: a carrier fluid, a viscosifier, a proppant, and a breaker. A fifth component is sometimes added, whose purpose is to control leak-off, or migration of the fluid into the fracture face. The first component is injected first, and actually creates/extends the fracture. Roughly, the purpose of these fluids is to first create/extend the fracture, then once it is opened, to deliver proppant into the fracture, which keeps the fracture from closing. The carrier fluid is simply the means by which the proppant and breaker are carried into the formation. Numerous substances can act as a suitable carrier fluid, though they are generally aqueous-based solutions that have been either gelled or foamed. Thus, the carrier fluid is often prepared by blending a polymeric gelling agent with an aqueous solution (sometimes oil-based, sometimes a multi-phase fluid is desirable); often, the polymeric gelling agent is a solvatable polysaccharide, e.g., galactomannan gums, glycomannan gums, and cellulose derivatives. The purpose of the solvatable (or hydratable) polysaccharides is to thicken the aqueous solution so that solid particles known as "proppant" (discussed below) can be suspended in the solution for delivery into the fracture. Thus the polysaccharides function as viscosifiers, that is, they increase the viscosity of the aqueous solution by 10 to 100 times, or even more. During high temperature applications, a cross-linking agent is further added which further increases the viscosity of the solution. The borate ion has been used extensively as a crosslinking agent for hydrated guar gums and other galactomannans to form aqueous gels, e.g., U.S. Pat. No. 3,059,909. Other demonstrably suitable cross-linking agents include: titanium (U.S. Pat. No. 3,888,312), chromium, iron, and zirconium (U.S. Pat. No. 3,301,723). More recently, viscoelastic surfactants have been developed which obviates the need for thickening agents, and hence cross-linking agents, see, e.g., U.S. Pat. No. 5,551,516; U.S. Pat. No. 5,258,137; and U.S. Pat. No. 4,725,372, all assigned/licensed to Schlumberger Dowell.

The purpose of the proppant is to keep the newly fractured formation in that fractured state, i.e., from reclosing after the fracturing process is completed; thus, it is designed to keep the fracture open—in other words to provide a permeable path for the hydrocarbon to flow through the fracture and into the wellbore. More specifically, the proppant provides channels within the fracture through which the hydrocarbon can flow into the wellbore and therefore be withdrawn or "produced." Typical material from which the proppant is made includes sand (e.g. 20–40 mesh), bauxite, and glass beads. Thus, the purpose of the fracturing fluid generally is two-fold: (1) to create or extend an existing fracture through high-pressure introduction into the geologic formation of interest; and (2) to simultaneously deliver the proppant into the fracture void space so that the proppant can create a permanent cavity through which the hydrocarbon can flow to the wellbore. Once this second step has been completed, it is desirable to remove the fracturing fluid from the fracture—its presence in the fracture is deleterious, since it plugs the fracture and therefore impedes the flow hydrocarbon. This effect is naturally greater in high permeability formations, since the fluid can readily fill the (larger) void spaces. This contamination of the fracture by the fluid is referred to as decreasing the effective fracture length. And the process of removing the fluid from the fracture once the proppant has been delivered is referred to as "fracture clean-up." For this, the final component of the fracture fluid becomes relevant: the breaker. The purpose of the breaker is to lower the viscosity of the fluid so that it is more easily removed fracture. Nevertheless, no completely satisfactory method exists to recover the fluid, and therefore prevent it from reducing the effective fracture length. Again, fluid recovery after delivering the proppant to the fracture represents one of the major technological dilemmas in the hydrocarbon production field. The instant Invention is directed to methods for recovering the fracturing fluid once the fluid has successfully delivered the proppant to the fracture Diminished effective fracture length (EFL) caused by fracture fluid retention in the fracture is an empirically demonstrable problem that results in substantially reduced well yields. Effective fracture length can be calculated by production decline and pressure transient analysis. The EFL values obtained this way can then be compared with the true fracture length obtained using standard geometry models.

Essentially, techniques for fracture clean-up, which again, refers to recovering the proppant-less fluid from the fracture, involve reducing the fluid's viscosity as much as practicable so that it more readily flows back towards the wellbore. Again, the goal is to recover as much fluid as possible, since fluid left in the fracture reduces the effective fracture length. Among the most troublesome aspect of fluid recovery, or clean-up is recovering that portion of the fluid at the very tip of the fracture.

The methods for fracture fluid clean-up taught in the prior art all involve removing the fracturing fluid through the same route by which the fluid was introduced into the fracture—i.e., by flowing or pumping the fluid up through the wellbore to the surface where it is removed. The disadvantages of this method are obvious. For one thing, the fluid must traverse the entire length of the fracture—a distance often over 1000 feet in low permeability formations—thus increasing contact with the fracture faces, hence contamination of the fracture faces with the fluid, which is known to reduce hydrocarbon yield. Moreover, clean-up this way is expensive and time-consuming, and rarely results in effective clean-up, i.e., fluid often remains in the fracture tip, thus decreasing the effective fracture length. Indeed the time-honored empirical observation is that the effective fracture length is about 50 to 60% of the fracture length—after clean-up. The method of the present Invention is directed to a method of fluid removal not involving traversal of the fracture length and up the wellbore. Instead, the fluid is removed by inducing the fluid flow into the fracture faces.

Although the method of the present Invention is novel in the art, the fundamental physical chemistry underlying the method has been applied in hydrocarbon well construction (as opposed to the quite distinct discipline of well stimulation, to which the present Invention is directed). More specifically, Eric van Oort, et al. at Shell in a series of SPE papers and U.S. Pat. No. 5,686,396, have investigated the problem of shale destabilization during drilling. E.g.: Eric van Oort, et al., *Physico-Chemical Stabilization of Shales*, SPE 37263; and Eric van Oort, et al., *Manipulation of Coupled Osmotic Flows for Stabilization of Shales Exposed to Water-Based Drilling Fluids*, SPE 30499, are both herein incorporated by reference, insofar as these two references disclose certain fundamental physical chemical principles related to the mechanism of fluid transfer between nonindigenous fluids and shale—well known in the art—necessary for a proper understanding of the present Invention. At least one other investigator has also looked into this problem. Jay P. Simpson, *Studies of the Effects of Drilling Fluid/Shale Interactions on Borehole Instability*, GasTIPS, 30, Spring 1997.

These authors/inventors posit that the economically devastating problem of shale instability—which is responsible for, among other things, stuck pipe due to well caving and collapse, cementing failures, and lost circulation—is caused by migration of low-solute fluid (i.e., the drilling fluid or "mud") into the surrounding shale. This movement occurs in response to a chemical potential gradient—i.e., the low-solute fluid moves to the high-solute fluid contained in the shale pore spaces. The result is that the shale surrounding the borehole can take up/absorb drilling fluid until it literally bursts—i.e., the outward stress exerted by the imbedded fluid overcomes the shale's intrinsic strength—with consequent problems for the contiguous wellbore. This unusual behavior of shale is a direct consequence of its ability to behave as a selectively permeable membrane (i.e., selectively permeable to water in preference to solutes).

U.S. Pat. No. 5,686,396 discloses a method for improving the osmotic efficiency of shale during the drilling process. More specifically, the method involves adding compositions to the drilling fluid so that the solute content of the drilling fluid more nearly matches that of the contiguous shale system. This way, the invasion or drilling fluid into the surrounding shale system is minimized. Again, the essential physico-chemical concepts relied upon by the inventors of the '396 patent are more or less the same as those relied upon in the present Invention; nevertheless, the application (drilling versus stimulation) and actual problem to be solved (keeping fluid out of the shale versus deliberately directing fluid into the shale) are drastically different. Therefore, the van Oort references, including the '396 patent, are directed to a different problem in an entirely different setting. Finally, the van Oort references only disclose (or suggest) exploiting indigenous membrane systems—none of these references teaches creating a selectively permeable membrane system where none exists. The present Invention is directed in part to the creation of such systems.

Likewise, numerous references—both patents and scholarly literature—disclose novel membrane compositions, some of which are suitable for use in accordance with the present Invention. U.S. Pat. No. 5,041,225, issued to Eddie (not assigned at the time of issue) discloses semi-permeable membranes intended for use in medical applications—e.g., body fluid diagnostic test strips and cell culture support members. The '225 patent discloses polytetrafluoroethylene (PTFE) membranes whose properties are modified by coating with a water-soluble polymer and a complexing agent (an ionic buffer salt acting as a catalyst) to render the membrane substantially hydrophylic. Yet the '225 patent discloses membranes for use in medical/diagnostic applications; the present Invention is directed to enhancing hydrocarbon production.

Similarly, U.S. Pat. No. 4,851,394, discloses semi-permeable membranes comprised of, among other things, compounds having multiple hydroxyl groups. Yet the membranes or "films" of the '394 application are intended by the inventors for use as edible food packaging material (e.g., sausage casings), and wound dressings.

SUMMARY OF THE INVENTION

The present Invention combines the results disclosed in the references discussed above, with additional empirical and theoretical findings germane to the specific problem sought to be solved—i.e., fracture clean-up. These latter findings refer to the relationship effective fracture length and well production, and the relationship between hydraulic and osmotic pressures in a fractured geologic formation: more particularly, under certain circumstances an increase in effective fracture length is achieved due to the removal of the same fluid from the fracture, and that under certain circumstances, chemical potential (or solute concentration) gradients can be created or induced in addition to hydraulic pressure gradients, that the solute concentration gradient can often be much greater than the hydraulic gradient (which is often zero in the region of interest), and that that differential is sufficiently large to influence the removal of fluid into the fracture face.

Additionally, the present Invention is also directed to methods and compositions for transferring fluids—by creating and exploiting the same chemical potential gradients—in the opposite direction, i.e., from the formation and into the fracture. The need for this type of fluid transfer might arise when it is desired to move stagnant fracturing fluid out of the reservoir into the fracture, as in the case of a water-blocked well. Deliberately inducing fluid flow from the reservoir contacting the fracture at that point will displace the fluid resident in the formation, thus moving it into the fracture and towards the wellbore, and therefore facilitating its recovery.

The essential features of one embodiment of the present Invention are shown in FIG. 3. In FIG. 3, a tip region is shown at 48; this tip has stagnant fluid. First, a high-solute region A is created in the formation immediately adjacent to the fracture, by injecting the appropriate fluid into the wellbore and allowing it to flow into the fracture and eventually migrate from the fracture into the formation. At the interface 50 between the formation and the fracture, a selectively permeable membrane 52 is established by injection of an appropriate membrane-forming, or membrane-promoting material into the wellbore and into the fracture.

This membrane 52 effectively creates two regions distinguishable based on solute content—the solute rich pore-fluids in the formation A, and the solute-poor region of the fracture B. And since these two regions are sealed off by a membrane permeable only to water (practically speaking: preferentially permeable to water) then only water can flow between the two regions A and B. Thus in response to the solute concentration gradient created, water comprising the fluid 54 held in the fracture flows along the flowpath shown at 56. Again, this is in stark contrast to the tradition flowpath depicting fluid removal of the prior art, shown at 58.

Thus, the present Invention is based on a novel combination of disparate insights (some new, others old), empirical observations, and physico-chemical phenomena. These are:

- shale (and other types of geological materials) can act as a semi-permeable membrane, selectively permeable for water;
- this membrane is sufficiently selective such that water can be transferred between two solution regions separated by that membrane;
- if such a membrane does not exist as an intrisic feature of the formation (e.g., in the case of sandstone) then one can be created at the fracture face by the injection of certain materials into the fracture;
- the more efficient the membrane the greater the osmotic pressure and therefore the greater the fluid transfer into the formation, or vice versa;
- a chemical potential gradient arises at the interface between a subsurface fracture and the contiguous geological formation, or more particularly between the aqueous-based fracturing fluid and the pore fluids in the interstices of the formation;
- this gradient, coupled with the formation, which behaves, or has been induced to behave, as a selectively permeable membrane, can be exploited to deliberately transfer fracturing fluid from the fracture to the formation;
- this fluid transfer can occur regardless of any opposing hydraulic pressure, because it is locally overwhelmed by the system's osmotic pressure;
- diminished hydrocarbon production due to damage to the fracture face caused by the intrusion of fluid into the face is, under certain circumstances, offset by the fluid's absence from the fracture; i.e., formation damage can be less important than effective fracture length; and
- the rate of osmotic flow (empirically demonstrated herein) is of sufficient magnitude to transfer acceptable quantities of fluid from the fracture tip into the adjacent fracture over acceptable time. (This is particularly true in low permeability formations.)

Again, the current state-of-the-art for removal of fracture fluids from a fracture (i.e., "fracture clean-up") teaches that the fluid must be removed through the same path through which the fluid came in: by traversing the entire length of the fracture (which in low-permeability formations may be over 1000 ft) then moving the fluid up the wellbore. Hence, regardless of the particular clean-up method employed, one feature common to all of those methods is that in every instance, the fluid is removed through the same path. The superficial appeal of this approach is difficult to argue with at first, since the fracture represents an open channel through which the fluid can move, and when the well is produced, fluid will travel naturally through the fracture towards the wellbore, up the wellbore, and to the surface.

The present Invention represents a drastic departure from this virtually uncontested orthodoxy. The essence of the present Invention is a method for removing the fracture fluid out of the fracture by deliberately directing or channeling the fluid towards the fracture face and into the formation. Conventional practice teaches that fouling of the fracture faces with fracture fluid ("fracture damage")—which contains, among other things, high molecular weight viscous organic polymers—is highly undesirable and should generally be avoided, and in no event intentionally induced. Put another way, the method of the present Invention is premised, in part, on an unusually counterintuitive insight—an insight that, until made, would discourage the skilled artisan from conceiving of the present Invention. This insight is that, in certain instances, for well productivity, increased effective fracture length is more important than the consequent formation damage, or loss in conductivity at the fracture faces. In other words, the method of the present Invention will often result in deliberate damage to the fracture face, i.e., the fracture fluid residue ("filtrate") will plug portions of the face thus rendering it less permeable to hydrocarbons. Damage of this type is undesirable according to those skilled in the art—it unquestionably results in diminished hydrocarbon production. Yet the present Invention is premised in part on the insight that, under certain conditions, decreased production due to fracture face damage is more than offset by increased production gained by increasing the effective fracture length (by removing fluid from the tip of the fracture).

Thus, according to the present Invention, while fracture face damage does ultimately lower permeability to hydrocarbon, and therefore inhibit production, the obverse benefit from moving the fluid into the fracture face is that the fluid is removed from the fracture itself, thus increasing the effective fracture length. This increase in effective fracture length can often enhance well production even accounting for the offset detriment of fracture face damage.

Therefore, the motivation to remove fracture fluid by intentionally directing it into the fracture faces is essentially absent in the art, for the reasons given above—i.e., it results in fracture face damage. Yet once that motivation is provided, what is needed is a cost-effective method to move the fluid into the fracture face. Thus the present Invention is directed to a method for removing the fracture fluid by forcing it into the fracture face. More specifically, the present Invention is directed to a method for fracture clean-up by creating and/or enhancing a chemical potential gradient (or an osmotic pressure gradient) between the stagnant fracturing fluid remaining in the fracture and the pore fluid in the contiguous formation. This gradient, once created, is then exploited to transfer the fracturing fluid into the formation along the gradient.

One advantage of the present Invention is that it results in increased effective fracture length, which in turn means that the rate of production and the production capacity will be enhanced. The rate of production is increased due to the additional flowpaths available to the hydrocarbon; and the overall production capacity is increased due to the enlarged drainage area (the region within the hydrocarbon-bearing formation from which the hydrocarbon is effectively extractable).

A second advantage of the present Invention is that since the effective fracture length is increased, the drainage area concomitantly increases, which in turn means that less wells need to be drilled in order to recover a given amount of hydrocarbon from the formation.

Yet another and related advantage of the present Invention is that, under certain circumstances, less breaker is required (thus substantially reducing the cost of well stimulation) since the fracturing fluid does not need to be removed by traversal of the entire fracture and up the wellbore, but rather is removed by the far shorter path of transfer into the adjacent fracture face. More specifically, for instance, the well operator may desire to use a single polymer for three distinct purposes: to gel the fluid (so that it is sufficiently viscous to disperse and deliver the proppant), to create the filter cake (so that the fluid delivered into the fracture to create it, does not leak off into the fracture face), and to create the selectively permeable membrane (of the present Invention).

DETAILED DESCRIPTION OF THE PREFERRED EMBODIMENTS

Figure 1:
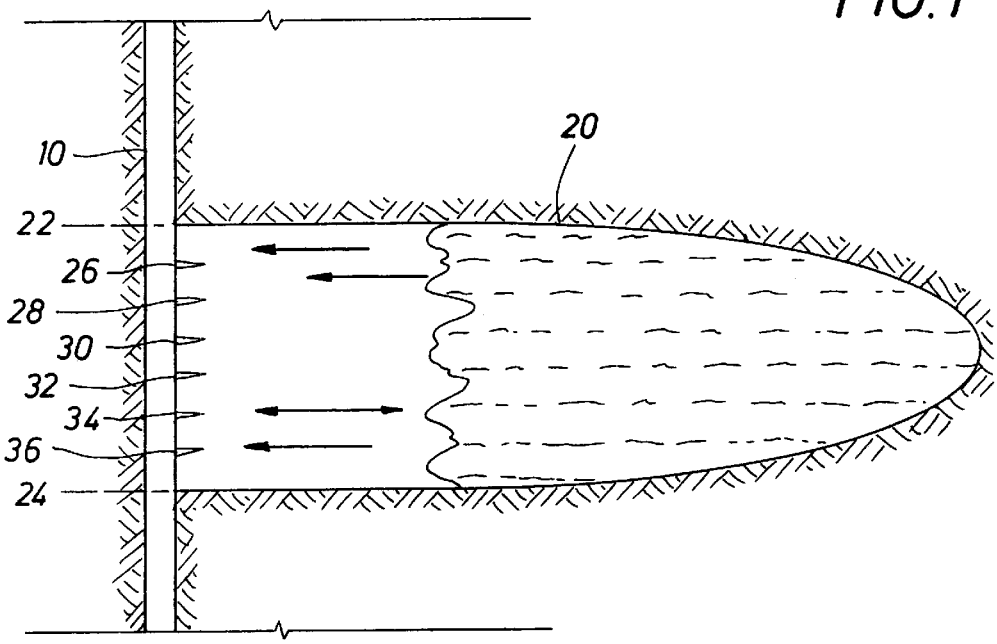
FIG. 1 depicts a stylized cross-sectional view of a typical fracture zone in a subsurface formation.
Figure 2:
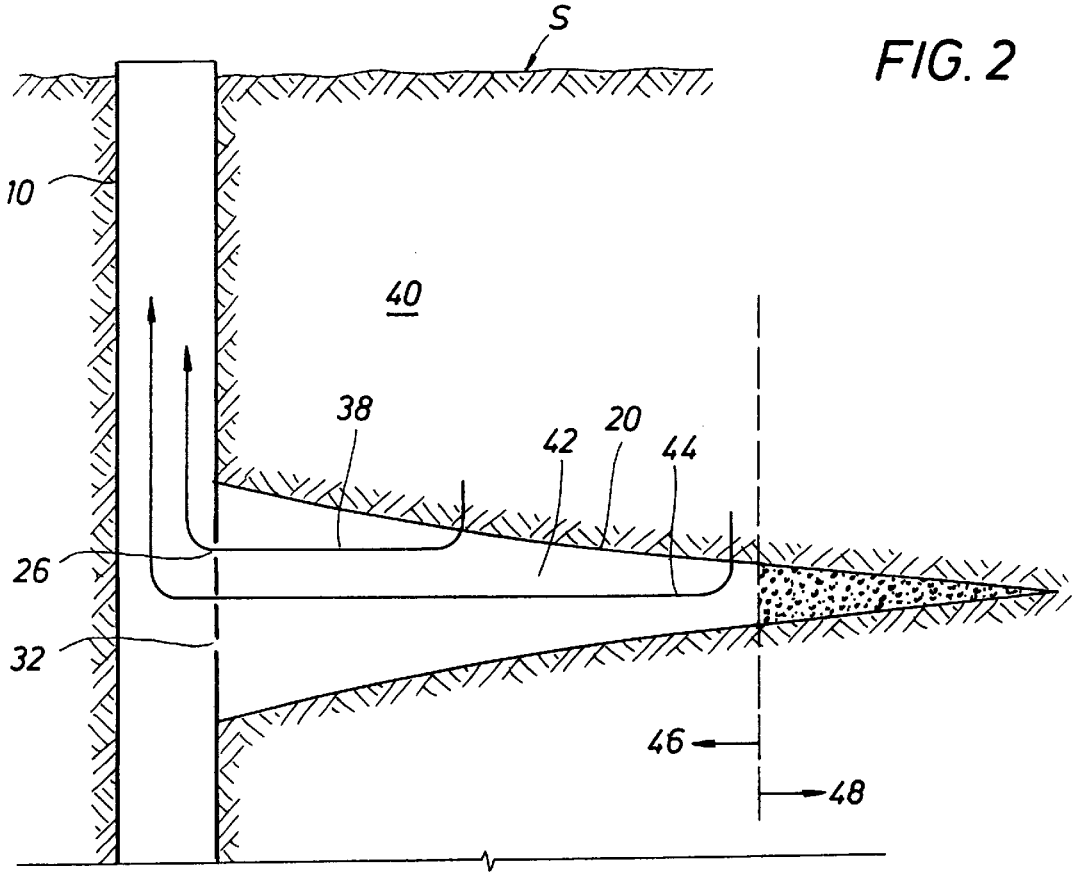
FIG. 2 depicts a cross-sectional view of a stylized fracture modified to show certain essential features of a typical fracturing operation.

Several preferred embodiments of the present Invention will now be described. The methods and compositions of the present Invention are conceptually inseparable, hence both will be discussed together.

Again, the essence of the present Invention is the deliberate transfer of selected components of a fluid from one discrete subterranean compartment to another by creating or enhancing a chemical potential gradient based on solute content, then establishing a selectively permeable membrane (or relying upon an extant one) that allows water to freely pass, but that is essentially impermeable to solutes. This latter step permits osmotic flow to occur. Thus, the less solute-dense fluid is driven by the chemical potential gradient into the adjacent compartment separated by the membrane, towards the region of higher solute content. The membrane prohibits solute transfer. This transfer will occur until it is balanced by the osmotic pressure.

As evidenced from the prior art cited above (e.g., the van Oort references) shales (among other geologic mat(rial comprising a subterranean oil-bearing formation) are preferentially permeable to water, thus act as semi-permeable membranes—allowing water to flow freely in response to a concentration gradient, yet inhibiting the flow of solutes. Thus, an aqueous fluid held stagnant in a fracture created in a shale formation, can be removed from the fracture by the intentional transfer to the shale.

More specifically, in a model subterranean environment having a deliberately created fracture, one can envision two distinct phases. The first phase is the water introduced into the fracture as a component of the suite of fluids injected into the fracture during fracturing, and held stagnant within the fracture; the second is the pore fluid entrained in the void spaces of the rock comprising the formation. These two phases can be thought of as separated by a membrane—which in this instance, is just the interface separating the two phases. If this membrane were freely permeable to all chemical species present in both fluids then diffusion would occur until the concentrations of all chemical species were equal on both sides of the membrane. Yet if this membrane is semi-permeable, or perhaps more descriptively, selectively permeable, e.g., if it is permeable only to water, then diffusion will occur selectively—water will diffuse across the membrane from the low solute region (the fracturing fluid) to the region of high solute content (the formation pore fluid). The activity of water on the fracture side is greater than the activity of the water on the formation side, due the greater solute concentration on the formation side. The pressure that must be applied to the solution on the formation side to make the activity of water equal to the activity of water on the fracture side (in the fracturing fluid) is the osmotic pressure. And if the pressure on the formation is less than this pressure, then water will flow from the fracture into the formation pore fluid by osmosis.

Equilibrium is reached by osmotic flow of solvent through the membrane to the solution, thus resulting in dilution and/or pressurizing of the solution (both of which increase the activity of the solution). The mechanical pressure which must be applied to the solution to prevent osmotic flow is called the osmotic pressure. The osmotic pressure, $\Delta\pi$, is given by $$\Delta\pi = \frac{RT}{\upsilon}\ln\left(\frac{a_1}{a_2}\right)$$

where R is the gas constant, T is the temperature, $\upsilon$ is the volume of one mole of solvent, $\alpha_1$ is the activity of the solvent, and $\alpha_2$ is the activity of the solution. If the fluids are dilute, then the previous equation can be simplified $$\Delta\pi = \nu\frac{\Delta nRT}{\upsilon} = \nu\Delta CRT$$

where $\Delta n$ and $\Delta C$ are respectively the difference in number of moles and concentration between the two fluids and $\upsilon$ is the number of constituent ions in the dissociating solute. ($\upsilon$ equals 1 for sugar solutions, 2 for NaCl and KCl solutions, and 3 for $CaCl_2$ solutions.) The osmotic pressure of 1:1 electrolyte solutions such as NaCl and KCl (at 21.1° C.) are listed in Table 1.

TABLE 1

| C [M] | $\pi$ [psi] (Eq. 1) | $\pi$ [psi] (Eq. 2) |
|---|---|---|
| 0.00 | 0 | 0 |
| 0.25 | 177 | 177 |
| 0.50 | 356 | 355 |
| 1.00 | 718 | 710 |

TABLE 1-continued

| C [M] | π [psi] (Eq. 1) | π [psi] (Eq. 2) |
|---|---|---|
| 1.50 | 1087 | 1064 |
| 2.00 | 1462 | 1419 |
| 4.00 | 3034 | 2839 |

Osmotic pressure is a colligative property that does not depend on the nature of the membrane provided the membrane is truly semi-permeable; however, the rate of osmotic flow does depend on the nature of the membrane. The influence of membrane properties on the volume flux across the membrane, $J_v$, is indicated by the typical expression $$J_v = L_p[\Delta P - \sigma_o \Delta\pi]$$

where $L_p$ is the hydraulic coefficient (constant for a given membrane and solvent), $\sigma_o$ is the osmotic reflection coefficient, and $\Delta P$ is the hydrostatic pressure applied across the membrane. Using D'Arcy's law, the hydraulic permeability coefficient can be related to the membrane permeability, K, by $$L_p = \frac{K}{\mu l}$$

where $\mu$ is the fluid viscosity and l is the membrane thickness. The reflection coefficient indicates the ideality of the semi-permeable membrane and determines the maximum osmotically induced pressure that can be achieved. $\sigma_o=1$ for an ideal membrane and $\sigma_o=0$ for a permeable membrane (i.e., one that does not impeded solute transport). The reflection coefficient must be determined empirically from experimental data since the mechanisms by which a semi-permeable membrane allows the passage of solvent molecules and prevents that of solute molecules are not well understood.

Low-permeability shales, for instance, can act as membranes (or at least imperfect membranes). According to the present Invention, water in the fracture fluid diffuses through the shale interface and into the more solute-rich shale pore fluid. The extent (equilibrium) of fluid transfer is dependent upon the solute differential between the two compartments separated by the membrane. Fluid transfer in response to the chemical potential gradient occurs until it is eventually countered by the osmotic pressure—i.e., the pressure exerted against the membrane by the fluid being diluted by solvent transfer. Or, thus fluid transfer occurs until equilibrium is reached. Moreover, the osmotic pressure is a function of the membrane's efficiency. Thus, an imperfect membrane will sustain a lower osmotic pressure since solvent and solute can readily migrate back and forth across the membrane until equilibrium is reached. Obviously, what is desired is to maximize fluid transfer from the fracture across the membrane and into the formation. As evidenced by this discussion, the skilled artisan can now see that the greater the efficiency of the membrane (i.e., the more selectively permeable it is to solvent) the greater the osmotic pressure it can sustain, and therefore the greater the solvent transfer at equilibrium. Thus, it is highly desirable to increase the efficiency of the membrane that exists in the subterranean formation and that separates the fracture from the formation. Occasionally the fractured formation comprises a naturally good membrane, for instance, a low-permeability shale is an effective membrane, which may not require any artificially established membrane in order to execute the method of the present Invention or an artificial membrane can be superimposed on the natural membrane to enhance its effectiveness. Yet a sandstone is not a suitable intrinsic membrane. In those instances where the formation does not provide a sufficient membrane, one must be artificially created to maximize fluid removal according to the present Invention.

In summary, the present Invention is premised on exploiting favorable chemical (or osmotic) gradients to transfer fluid. More particularly, the fracturing fluid—or the aqueous component of the fluid—is deliberately transferred from the fracture into the contiguous formation. The driving force for this transfer is twofold: (1) the disparity in solute content between the fracturing fluid (less solute-rich) and the pore fluid of the formation (more solute-rich); and (2) the presence of a selectively permeable membrane. This disparity gives rise to a chemical potential gradient. The membrane—which for present purposes is a membrane permeable only to water and nothing else—restricts solute movement between the two compartments that it separates. What it does not restrict is the water contained in the fluid(s) introduced into the fracture during the fracturing and fracture clean-up process. This water migrates across the membrane in response to a favorable solute concentration gradient, into the contiguous formation. The result is fluid removal from the fracture (into the formation) thus increasing the effective fracture length, thus increasing well productivity.

One significant advantage of the method of the present Invention is that its execution can be subsumed within the typical fracturing process—thus allowing the well operator to perform the fracture and the fracture clean-up almost as a single operation. Thus, the following description of the method of the present Invention will include the entire fracture process as well as the specific steps related to fracture clean-up, which is the center of gravity of the present Invention.

First, the fracture is created in the particular subsurface formation of interest. This is generally done by injecting fluid into the wellbore. Numerous types of fluids, referred to herein as "fracture-inducing fluids" are well know to the engineer skilled in the art of well stimulation. The present Invention is not limited to a particular fracture-inducing fluid. For instance, a fracture-inducing fluid suitable for use with the present Invention can be a water-based fluid, or alternatively, it can be a foam fracturing fluid, injected with $CO_2$ or $NO_2$. In one particularly preferred embodiment, the fracture inducing fluid contains a brine solution, or a solution having a very high solute concentration. The purpose of the brine solution is to establish the chemical potential gradient, by establishing a region of high solute solution on the formation side of the interface. This brine solution can either be co-injected with the fracture-inducing fluid or it can be injected separately. Moreover, the purpose of the brine solution is to create a solute-rich region in the formation immediately adjacent to the fracture. In some instances, this region may exist naturally without the need to artificially create it; nevertheless, without the membrane in place, osmotic flow cannot occur. Moreover, in those instances when the solute-rich region or the membrane occurs naturally, it is still preferred to execute both of these steps in the present Invention in order to achieve osmotic flow of a rate sufficient to transfer sufficient amounts of fluid out of the fracture.

Once this region is established, it is sealed with a semi-permeable membrane (described below) thus separating two regions based on solute content, and thus establishing an osmotic gradient. The skilled artisan will immediately understand that osmotic pressure is a colligative property, thus the effect on osmotic pressure of the nature of the chemical species is, in theory, irrelevant. In practice, the size and electrostatic charge of the particular chemical species will of course affect osmotic flow. (This suggests that the fluid used to establish the solute-rich region and the membrane material should be selected in coordination). Thus, numerous chemical species are acceptable to establish the solute-rich region in the formation—the species can be, for instance, inorganic and charged (e.g., MgCl) or organic and electroneutral (e.g., sugar).

Next, the semi-permeable membrane is established. The list of possible materials that can form a membrane suitable for the present Invention is long. Yet the person skilled in the art of membrane chemistry, working in concert with one skilled in the art of reservoir engineering can select suitable candidates for the membrane material by following the general guidance provided in the present Specification, by following the teachings in the art, and by following these specific guidelines. The following reference are helpful in this regard and are hereby incorporated by reference into the present Application. H. P. Gregor and C. D. Gregor, *Synthetic-Membrane Technology* 239, Scientific American 112 (1978); R. Durbin, Osmotic Flow and Water *Across Permeable Cellulose Membranes*, 44 J. General Physiol. 315 (1960). Preferred membranes of the present Invention should possess the following attributes. First, the membrane must be water-wettable. Second, the membrane material once in place, should comprise pore spaces of sufficient size to yield acceptable capillary pressures. Naturally, the membrane should be easy and cost-effective to establish. And of course, numerous more specific considerations, known to the one skilled in the arts to which this Invention is directed, will direct the engineer or well operator to the optimal membrane candidate. For instance, in the brine stages of the fracture treatment, conventional polymers may not be suitable due to their tendency to destabilize at high temperatures in the presence of brine.

Again, the formation itself may, in rare instances, provide an intrinsic membrane—without the need to establish one artificially. Whether this natural membrane is sufficient to achieve the desired osmotic gradient in accordance with the present Inventions is not clear. The '396 patent—a primary teaching in this technology, discussed earlier, strongly suggests that the formation's natural geology even in the most favorable instance, i.e. shales, is insufficient to drive fluids by osmotic fluids. Indeed the '396 patent is directed solely to a method for improving the osmotic efficiency of shales. In addition, this reference states that osmotic flow in fractured shales is expected to be "strongly reduced," presumably due to leak-off, flow by other means and the inherent heterogeneity of shale. Therefore, while nearly any substance (even air) can behave as a semi-permeable membrane, the current teaching in the art suggests that formation rock is not an adequate membrane to transfer fluid from a fracture to the formation, to any appreciable degree to practice the present Invention. Thus, practicing the present Invention will nearly always require an artificially established membrane. Moreover, in other instances, a suitable membrane may exist, having been established during another step in the fracturing process—e.g., lining the fracture faces with filter cake to prevent leak-off of the fracture-inducing fluid.

If one desires to establish a selectively permeable membrane suitable to practice the present Invention, then it can be done, for instance, by injecting into the fracture a membrane-forming material (e.g., a conventional fluid-loss additive). This membrane-forming material—since it is preferably introduced with or after the brine solution contained in the fracture-inducing fluid—forms a membrane layer at the fracture face, thus ideally sealing in the solute-rich solution-containing formation. The ideal membrane is one that is freely permeable to water, but impermeable to all solutes. Again, creating this membrane may comprise a separate step—i.e., it is not an intrinsic part of the fracturing process—or a coating placed on the formation from a prior step in the fracturing process may be further utilized as the membrane of the present Invention. For instance, a "filter cake," comprised of, for instance, a dewatered guar gum, is often deliberately established on the formation facing the fracture. The purpose of this filter cake is to prevent leak-off, or loss of the fracture-inducing fluid into the formation. A filter cake can also be created (generally unintentionally, when a guar gum solution carrying proppant is delivered into the fracture and the gum sticks to the formation and dewaters, forming a filter cake. Thus, the filter cake diverts the fluid's flow path so that instead of moving laterally into the formation, it moves perpendicular to the wellbore and the formation, thus extending the fracture. The point is that this filter cake can then be used as the selectively permeable membrane of the present Invention. Thus, it may be desirable to manipulate the composition of the material used to create the filter coke so that it forms a membrane suitable for the present Invention.

Numerous materials can be to establish the membrane of the present Invention. Several membrane compositions suitable upon modification for use in accordance with the present Invention include those disclosed in U.S. Pat. No. 5,041,225, and U.S. Pat. No. 4,851,395 (both discussed previously). In particular, the '394 patent discloses membranes comprised of polyhydroxy compounds. Both of these patents are incorporated by reference herein. Galactomannans crosslinked with boric acid, and cellulose acetate (commonly used in dialysis) can also form membranes suitable for use in the present Invention.

In one preferred embodiment of the present Invention, the membrane is comprised of polyhydroxy compounds; in one particularly preferred embodiment, it is comprised of polyethylene glycol. Other types of materials are also particularly suitable: e.g., J100 consisting of colloids/polymers; J126 consisting of aluminosilicate and fatty acid; J478, a starch polymer; J84, which is silica flower; and J418, silica flour—all sold by Schlumberger Dowell as conventional fluid-loss additives, originally designed for a separate purpose, but nonetheless suitable for the present Invention.

The membrane of the present Invention can also be prepared from inorganic materials, the several preferred embodiments shall be discussed below. A copper hexacyanoferrate membrane can be formed either by sequential injection of solutions, or by the injection of one solution followed by the diffusion of the solute from a second solution. Copper sulfate and potassium ferrocyanide are known to react on contact to form a copper hexacyanoferrate membrane. In addition silicates can form membranes suitable for the present Invention. More particularly, clays, such as bentonite, are preferred embodiments of the present Invention.

Yet, in still other preferred embodiments, this step—i.e., establishing the semi-permeable membrane—is not necessary. For instance, the geochemistry/geology of the formation may create semi-permeable membrane naturally, e.g., shale is such a material, while sandstone would generally require a membrane-forming material. Yet this is rare. Moreover, this should not be understood to mean that sufficient osmotic transfer—of the type claimed here—will occur. Indeed, even if such a membrane is established between the formation and fracture, the fluids in each compartment will have about equal solute concentration—in any event, almost always too low to establish a solute gradient sufficient to achieving the desired osmotic transfer.

Finally, once the solute-rich region has been established, it has been sealed in by the selectively permeable membrane, then the 2 regions, distinguishable by solute concentration can be observed. Note that the three "layers" (high-solute region, membrane, and low-solute region) are not necessarily established separately or independently of one another, and certainly not necessarily in any particular sequence; the foregoing description is merely heuristic, hence it omits much of what is well know to the skilled engineer.

Obviously, the low-solute region is inherently established in the fracture itself, opposite the region of high solute content; and the two regions are separated by the semi-permeable membrane. This region is established during ordinary fracture treatment by injecting into the fracture proppant delivered in an aqueous matrix. Note again, that this step is intrinsic in the fracturing process itself since proppant is delivered into the fracture after the fracture is created for the purpose of keeping the fracture open. Once these three regions are created: the high solute region, the membrane, and the low solute region, then the requisite conditions are established—and the invention is operable.

At this point, the fracture has been created, and permanently supported by the proppant. Now, it is generally desirable to "clean-up" the fracture, which generally refers to removing fluid (i.e., the aqueous matrix that carried the proppant) from the fracture. More specifically, for instance, the fluid near the tip of the fracture is the most difficult to remove, so it is to this portion of the fluid that clean-up is often, though not always, directed. A typical first step in clean-up involves allowing the fluids to "break." Breaking refers to materials added to the fracturing fluid (the fluid carrying proppant) which break down the fluid, or cause the fluid to lose its viscosity. To retrieve the fracturing fluid once it has delivered the proppant, it is necessary to reduce the viscosity of the fluid—they must initially be viscous so they can adequately entrain hence transport the proppant material—so that they will flow better during clean-up, that is, they are more mobile, hence can more readily traverse the length of the wellbore and move up through the wellbore. (Schlumberger Dowell's ClearFRAC is an exception). The method of the present Invention is operable without regard to the types or amounts of breakers used.

A substantial fraction of the fluid can still be removed using convention techniques—i.e., removing it through the wellbore by producing the well. Or, depending upon the pressure gradient present in the fracture and wellbore, the fluid (with the exception of that portion of the fracture tip that is hydraulically isolated from the rest of the fracture) will traverse the fracture and move up the wellbore on its own, without pumping.

Once the membrane is in place, water can migrate into the solute-rich formation pore-fluids—i.e., osmosis can occur. Again, this flow is thermodynamically favorable. Thus the stagnant low solute fluid—that was not recovered by movement back through the fracture and up the wellbore—flows across the membrane, in response to a solute gradient. This flow occurs until it is offset by the osmotic pressure. According to the prior discussion, the more efficient the membrane (that is, the greater its selectivity for water over solutes) the greater the osmotic pressure, and therefore the greater the flow of water to the formation pore fluid.

Again, the low solute fluid flows across the membrane into the fracture face, or into the formation. Thus fracture fluid has been removed from the fracture, therefore increasing effective fracture length, therefore increasing the well's effective bore radius, and finally therefore increasing hydrocarbon production.

The method of the present Invention is readily operable without limitations as to the type of fracturing fluid or breaker. Virtually all fracturing fluids contain a carrier fluid which is conventionally an aqueous liquid, and a viscosifying polymer. Additionally, the fracturing fluid will generally also contain one or more additives such as surfactants, salts (e.g., potassium chloride) anti-foam agents, bactericides, and cross-linking agents for the polymeric thickener. The method of the present Invention is operable, for instance, with ClearFRAC, a polymer-free fracturing fluid, developed and sold by Schlumberger Dowell. ClearFRAC is a Schlumberger trademark applied to fracturing fluid additives disclosed and claimed in U.S. Pat. No. 5,551,516, issued to Norman, et al., and assigned to Schlumberger Dowell.

Likewise, the method of the present Invention is readily operable without limitations as to the type of breaker. Again, breakers are added to the fracturing fluid mixture to "break" or destroy/diminish the viscosity of the fracturing fluid (the matrix carrying the proppant) so that this fluid is more easily recovered from the fracture during clean-up. Examples of breakers suitable for use in the method of the present Invention include enzymes (oxidizers and oxidizer catalysts). Additionally, the breakers can be encapsulated to delay their release, according to U.S. Pat. No. 4,741,401, herein incorporated by reference, issued to Walles, et al. and assigned to Schlumberger Dowell.

Despite the firm theoretical underpinning for the present Invention, and despite the prior studies demonstrating fluid movement in subsurface environments in response to osmotic gradients (e.g. drilling fluids into shales), whether fracture clean-up can actually occur to any appreciable degree has not been demonstrated. Obviously any computer simulation designed to mold fluid movement in a fractured subsurface formation is only as reliable as the choice of value for the osmotic flow parameter. Likewise on laboratory experiments intended to demonstrate the efficiency of fracture fluid removal from a subsurface fracture or limited by the inability to reproduce actual subsurface conditions. Therefore, one generally preferred way to assess the efficiency with such a downhole technique is to rely upon a computer model which simulates—as much as possible—the real world conditions. Yet the parameters input into the model's algorithm (in this case, the parameters depicting osmotic flow) are determined by laboratory experiment.

Thus, the following examples are intended to further illustrate the present Invention—i.e., they demonstrate the effectiveness of the methods and compositions of the present Invention for removing fluid from a fracture tip. The examples that follow are separated into two sets. The first set depicts laboratory experiments designed to determine, among other things, realistic empirical parameters to describe osmotic flow, or fluid flow driven solely by an osmotic gradient (i.e., no hydraulic component driving the flow). Once those parameters are determined by experiment, they are then incorporated into a simple mathematical model to mimic fluid removal from a fracture. This model is very simple and is based on parameters and equations well known to the skilled artisan. The model results predict the effectiveness of the present Invention in removing fluid from a fracture—again, based on experimentally derived values for the key parameter—osmotic flow. These results are presented in the second example. Thus, the two examples taken together show the efficacy of the present Invention in a model environment intended to mimic actual subsurface conditions—the model simulates conditions in the subsurface, based on a realistic osmotic flow parameters determined experimentally.

EXAMPLE 1

Laboratory Determination of Realistic Osmotic Flow Parameter

The objective of the study presented in this Example is to: (1) illustrate the effectiveness of osmosis for inducing the flow of fluids in porous media; and (2) obtain an empirically based parameter to describe the osmotic flow (osmotic flux in cm/s) so that this parameter can be used to model, by computer simulation, the flow of fracturing fluid in the subsurface.

Experimental Protocol

Figure 4A:
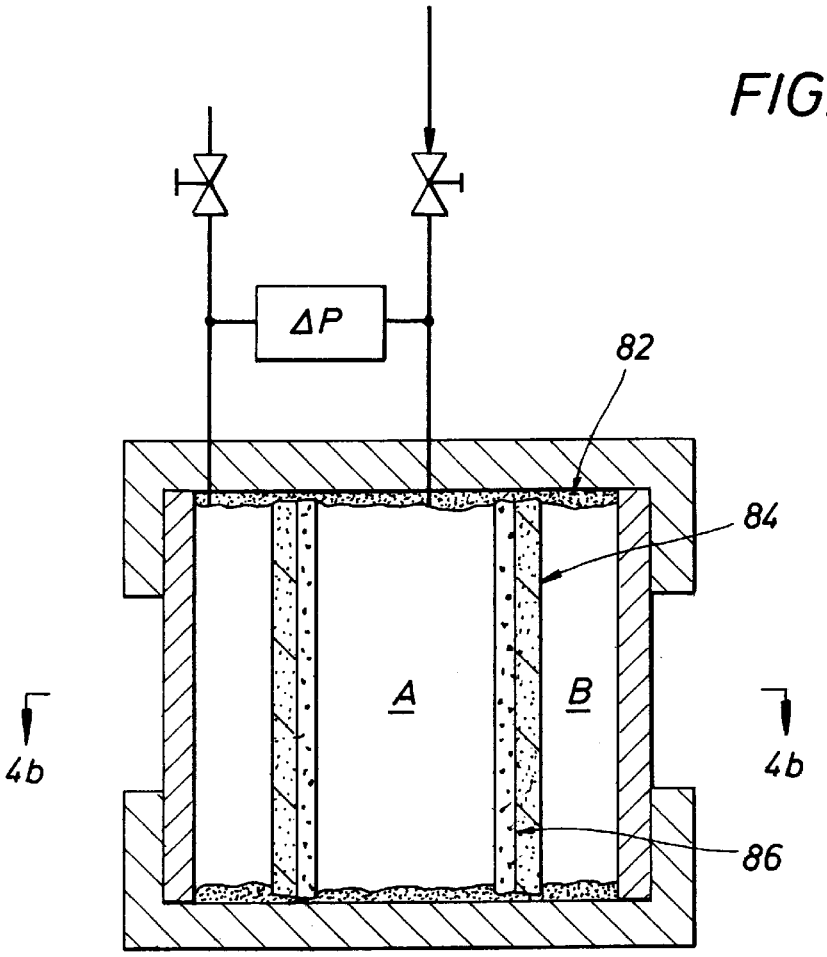
FIG. 4*a* is a schematic cross-sectional view of a radial osmotic cell.
Figure 4B:
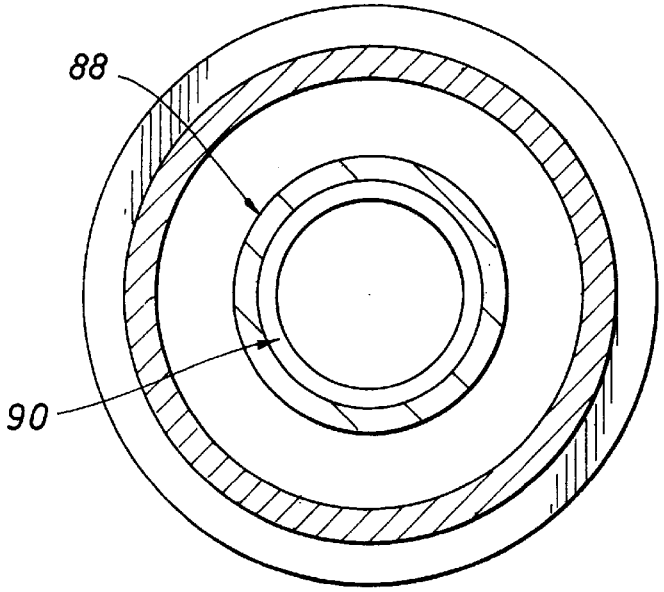
FIG. 4*b* shows some cell in top view.

Radial Osmotic Cell. Osmotic experiments were conducted in the radial osmotic cell shown schematically in FIG. 4. The chamber marked "A" contains the solvent; the chamber marked as "B" concerns the solution. The DI water enters the cell from a reservoir by line 80. The epoxy/silicon sealant is show as 82; the membrane and core as shown at 84, 88, and 86, 90, respectively. A Fan 90 core (OD of 1.5 in., length of about 1.25 in., and pore size of 60 $\mu$m) was used to separate the inner and outer chambers and to support the semi-permeable membrane attached to the outer surface of the core. The top and bottom surfaces of the core were coated with a thin layer of epoxy and sealed in the osmotic cell using a silicon sealant. The silicon sealant was capable of supporting about 160 psi of differential pressure without rupturing. The solvent (DI water) was placed in the inner chamber and the solution (e.g., sugar or KCl solution) was placed in the outer chamber. The core was vacuum saturated to ensure that the core was saturated with the fluid in chamber A. The resulting Osmotic flow was from the inner to the outer chamber. The outer chamber was a closed system, so the osmotic flow resulted in an increase in pressure in the outer chamber. The inner chamber was either a closed system or connected to a DI water reservoir at constant pressure. For the closed system, the osmotic flow resulted in a decrease in pressure in the inner chamber. (The reverse fluid/membrane alignment was avoided to prevent fracturing the core.) The differential pressure change across the membrane was measured using a differential pressure transducer.

Figure 5:
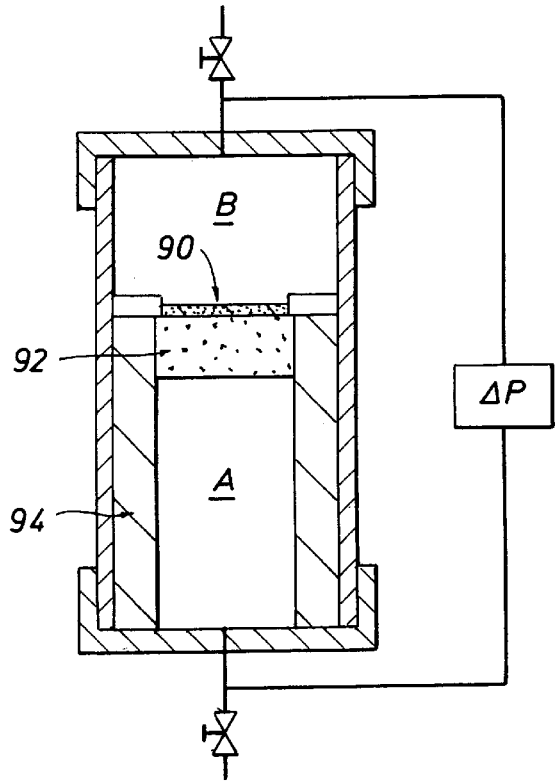
FIG. 5 is a schematic cross-sectional view of a linear osmotic cell.

Linear Osmotic Cell. Osmotic experiments were conducted in the linear osmotic cell shown schematically in FIG. 5. The membrane is shown as 90, and the core as 92. The overburden sleeve/fluid is shown as 94. The linear cell is a combination of a Hassler cell (side A) and a fluid loss cell (side B). Berea sandstone cores 2 in. in diameter and between ½ and 10 in. in length were used in this study. The cores had a permeability of about 8 md and a porosity of about 19%. The cores were mounted in side A of the cell and an overburden pressure of at least 500 psi was applied to prevent flow from bypassing the core. The cores were initially vacuum saturated with the desired fluid and a semi-permeable membrane seas attached to one side of the core. The saturating fluid, position of the membrane, and data collected during the experiment were dependent upon the way the experiment was conducted (either constant volume or "constant" pressure).

Constant Volume. During constant volume experiments, the cores were initially vacuum saturated with the solvent (DI water) and a semi-permeable membrane was attached to side B of the core. The solvent was placed in chamber A and the solution was placed in chamber B. The resulting osmotic flow was from chamber A to chamber B. Chamber B was a closed system, so the osmotic flow resulted in an increase in pressure in chamber B. Chamber A was either a closed system or connected to a DI water reservoir at constant pressure. For the closed system, the osmotic flow resulted in a decrease in pressure in chamber A. The differential pressure change across the membrane was measured using a differential pressure transducer. This alignment is consistent with the flow of solvent from a formation into a fracture.

"Constant" Pressure. During constant pressure experiments, the cores were initially vacuum saturated with the solution and a semi-permeable membrane was attached to side A of the core. The solvent and solution were again placed in chambers A and B, respectively, and the resulting osmotic flow was from chamber A to chamber B. (Constant volume experiments could not be conducted with this alignment because the resulting pressure on the membrane would not be supported by the core, thus causing the membrane to rupture.) The chamber sample lines were connected to graduated capillary tubes that were both at atmospheric pressure. The changes in solution and solvent volumes were measured during the course of the experiment. The differential pressure across the membrane was relatively constant so the membrane was not exposed to a large differential pressure that would cause it to rupture. This alignment is consistent with the flow of solvent from a fracture into a formation.

Semi-Permeable Membranes

Cellulose Ester Dialysis Membrane. A cellulose ester dialysis membrane with a molecular weight cut off of 100 was used in this study. Dialysis membranes were epoxied directly to the cores prior to being mounted in the osmotic cells. Consequently, the dialysis membranes became dehydrated while the epoxy was dried. The membranes were rehydrated when exposed to a concentration gradient (osmotic flow) during the initial stages of the experiments.

Guar/borate Filter Cake. Guar/borate filter cakes were prepared from 60 lb/Mgal crosslinked polymer (YF160 crosslinked with L10). The polymer was placed in chamber B of the linear osmotic cell, a cake was generated on side B of the core using an applied pressure of 1400 psi for at least 1 hour, and the excess polymer was removed from the cell. The resulting cakes were typically about 3 mm in thickness, contained at least 600 lb/Mgal of polymer, and had permeabilities of about 0.015 md (assuming no loss in permeability of the core). The cakes were soaked in DI water for at least 3 hours prior to conducting osmotic experiments to eliminate any effects resulting from expansion of the cake after the applied pressure was relieved.

Results and Discussion

Example 1 depicts osmotic experiments were conducted using a variety of solution/membrane/DI water systems. The solutions used in this study were sugar, KCl, and guar. Results for guar solutions were not significant and, therefore, will not be discussed. [A 60 lb/Mgal linear guar solution (WF160) was found to be ineffective in generating osmotic flow (because the activity is not significantly different from that of pure water). Two types of semi-permeable membranes were investigated: cellulose ester dialysis membranes and borate crosslinked guar filter cakes. Most experiments were conducted with the dialysis membranes;. The guar/borate filter cakes were investigated to address the potential for osmotic flow with existing fracturing fluids.

Figure 6:
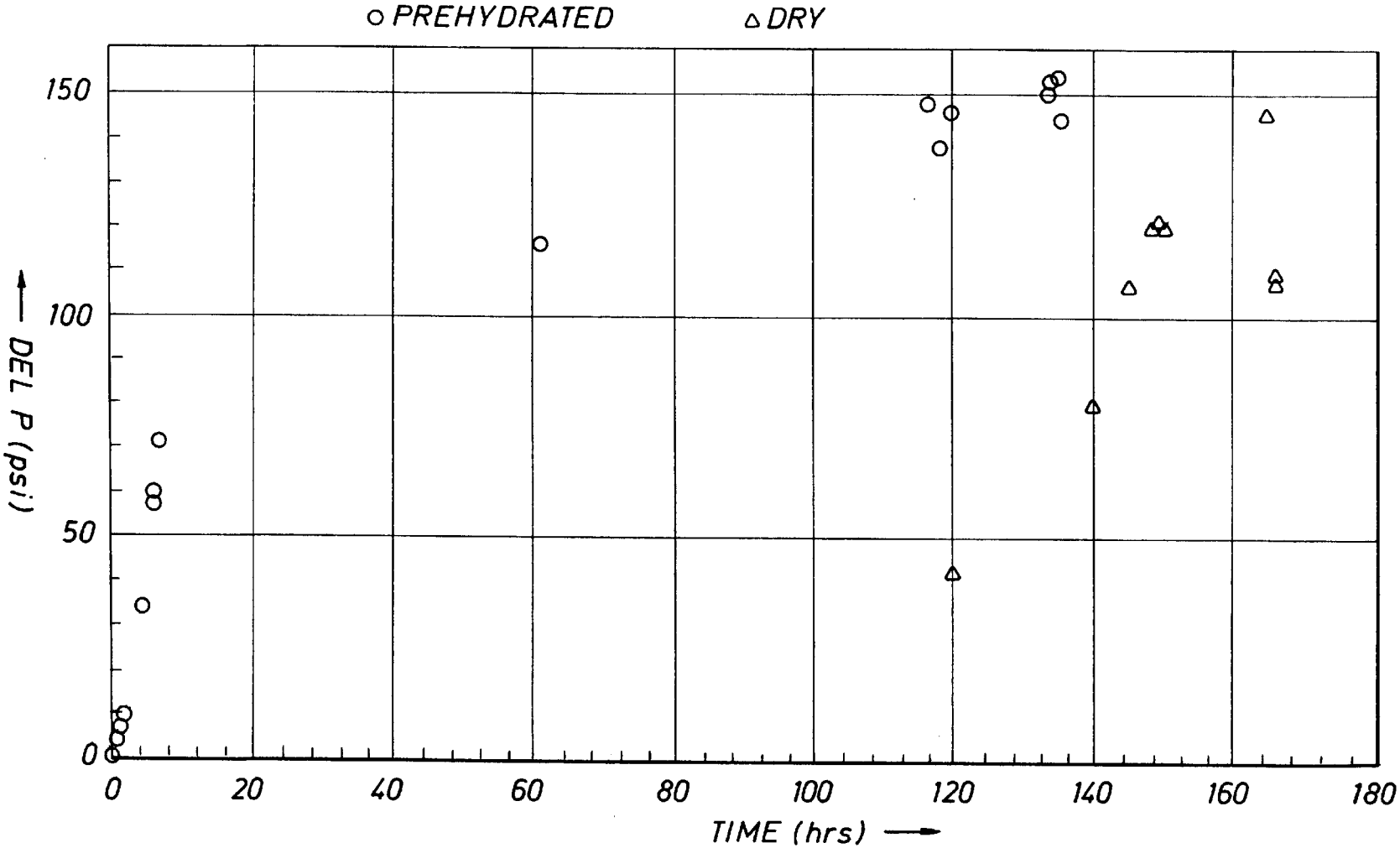
FIG. 6 is a graph depicting osmotic pressure response with 1.5 m sugar/dialysis membrane/DT water system as a function of time using a radial osmotic cell.

Cellulose Ester Dialysis Membranes. The pressure response for osmotic experiments in the radial cell are shown in FIG. 6. Experiments were conducted with a dialysis membrane and 1.5 M sugar/DI water as the fluids. The results demonstrate the effects of membrane hydration on the rate of osmotic transfer. The pressure response after epoxying the membrane to the core and allowing it to dry indicates a delay in osmotic flow as the membrane rehydrates. [Dehydration affects the pore size of the membrane (as well as the vapor/liquid equilibrium within the pores of the membrane) .] After 110 hours, an increase in pressure was observed due to osmotic flow. The pressure reached a maximum of approximately 150 psi and then oscillated due to leaks in the silicon sealant separating the two chambers. The pressure was released at 180 hours, the chambers were emptied and refilled with fresh fluid, and the experiment was repeated. Results with the prehydrated membrane reveal a rapid (almost exponential) increase in the pressure due to immediate osmotic flow. The pressure again stabilized at about 150 psi. The theoretical osmotic pressure for this 1.5 M sugar/DI water system is approximately 1100 psi. The discrepancy in the observed osmotic pressure is due to leaks in the system and limitations of the membrane ($\sigma_o$<1).

Figure 7:
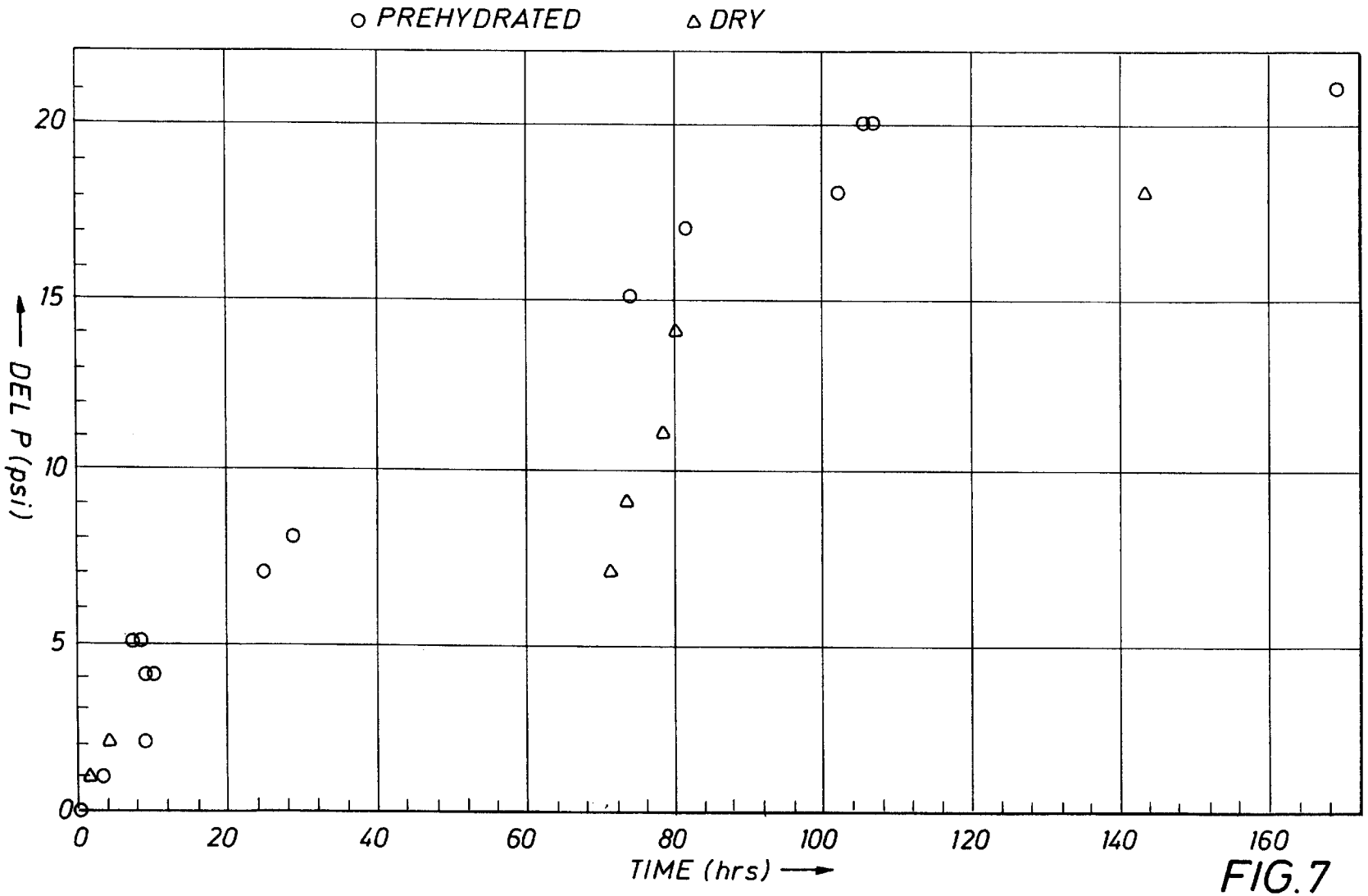
FIG. 7 is a graph depicting osmotic pressure response with 1.5 m sugar/dialysis membrane/DT water system as a function of time using a linear osmotic cell.

Similar results, shown in FIG. 7, were obtained with the 1.5 M sugar/dialysis membrane/DI water (1 in. DI water saturated core) system in the linear osmotic cell. A delay of about 70 hours was observed prior to a rapid increase in the osmotic pressure to about 18 psi with the dry membrane. The pressure was released at 150 hours and the chambers were refilled with the appropriate fluids. The delay was not observed with the prehydrated membrane, however, a more gradual increase in the osmotic pressure to about 20 psi was observed (15 psi of which was manifested as a decrease in pressure in the DI water chamber). In a similar experiment with a 10 in. DI water saturated core, no increase in osmotic pressure was observed even after 150 hours. The inability to generate expected osmotic pressures and the uncommon sigmoidal shape of the pressure response curves are consistent with membrane dehydration due to decrease in water saturation of the core. The osmotic flow of water was from the porous medium, through the membrane, and into the sugar solution. As the water was transported out of the porous medium, the resulting pressure gradient in the core was not sufficient for D'Arcy flow to replenish the water near the membrane as rapidly as osmosis was removing it. Thus, a decrease in water saturation within the porous medium occurred near the membrane. This decrease in water saturation caused the membrane to become dehydrated as the water within the pores of the membrane was osmotically transported into the sugar solution and not replaced by water from the porous medium. As a result of dehydration, the membrane become brittle and unable to transport fluids. This dehydration phenomenon resulted in a decrease in the rate of osmotic flow as the saturation in the porous medium decreased and eventually stopped osmotic flow when the saturation became too low and/or the membrane became dehydrated and brittle. The time at which osmotic flow stops depends on the rate at which the saturation decreases and, therefore, depends on the rate of D'Arcy flow (i.e., is a function of the length and permeability of the porous medium).

The dehydration phenomenon is supported by the formation of a brittle dialysis membrane when exposing it to an air/KCl system. The water initially within the pores of the membrane (the membrane was not dried) was removed due to osmotic flow into the KCl solution and replaced by air. As the pores were dehydrated, the membrane became brittle and osmotic flow stopped. (No such changes were observed when the membrane was exposed to an air/DI water system.) These results are consistent with the presence of a liquid phase within the pores of the membrane and, thus, indicate that osmotic flow through the cellulose ester membrane is occurring via liquid flow.

Figure 8:
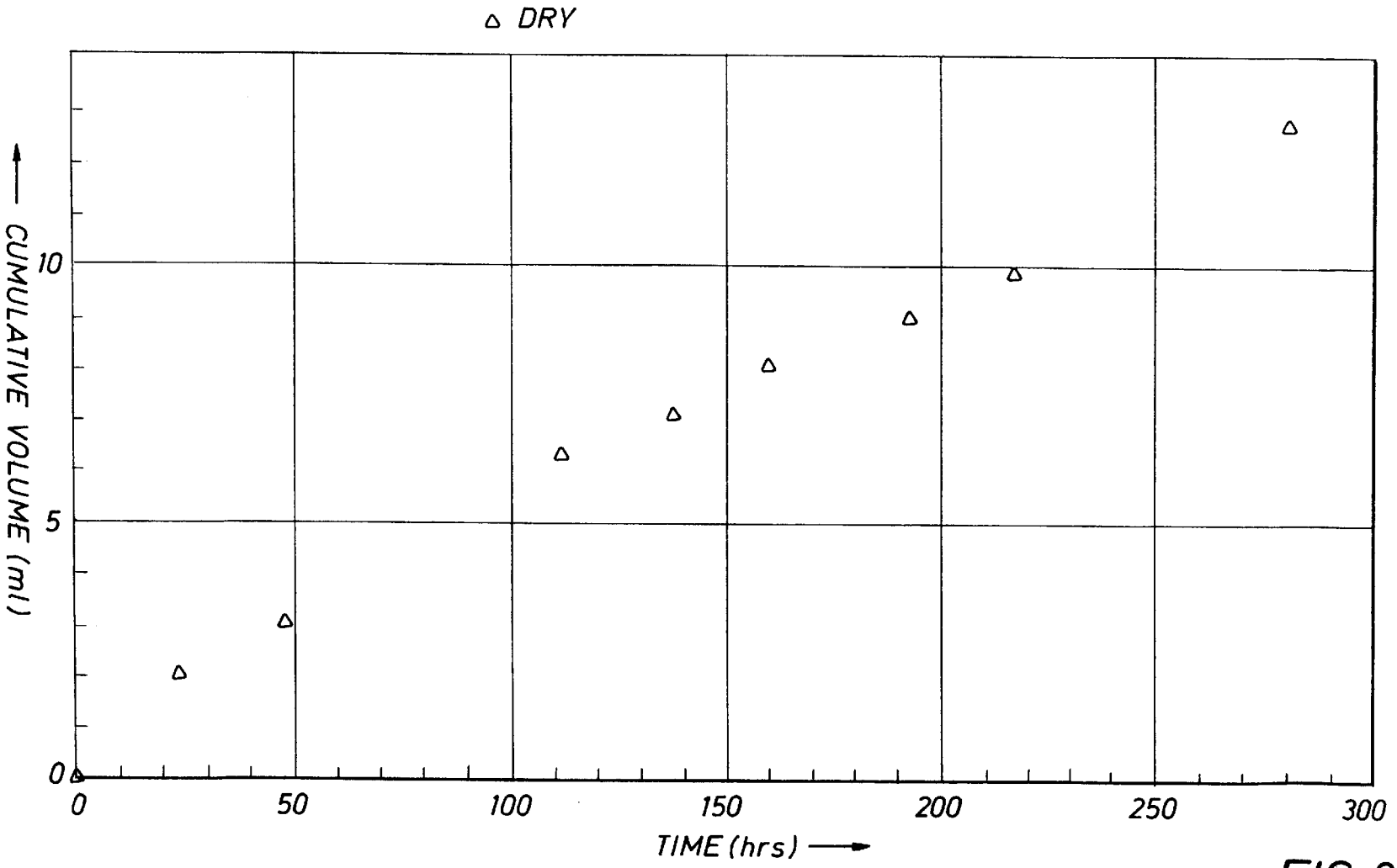
FIG. 8 is a graph depicting cumulative water volume transfer through the membrane with a 4.0 m KCl/dialysis membrane/DI water system.

To prevent dehydration of the membrane, the direction of osmotic flow was reversed using a constant pressure experiment. The direction of osmotic flow was from DI water in chamber B, through the membrane, and in to a 4.0 M KCl saturated core. The cumulative volume of DI water transferred through the membrane is shown in FIG. 8. Thus, the volume flux across the membrane is about 0.025 cm/hr (the membrane surface area was 1.5 $cm^2$) and is relatively constant over the range of 50 to 280 hours. This constant rate indicates no membrane dehydration problems (i.e. no decrease in water saturation), as expected when transferring water into the porous medium rather than out of the medium. An effective membrane permeability of about $6\times10^{-6}$ md was determined from the latter two equations presented earlier (conservatively assuming a membrane thickness of 1 mm and $\sigma_o$=1). Note that the pressure gradient across the membrane was no more than 1 psi throughout the experiment. Therefore, the observed transfer of water across the membrane is not due to D'Arcy flow.

Guar/borate Filter Cakes. Osmotic experiments were conducted using borate crosslinked guar filter cakes as the semi-permeable membranes. Pressure changes were relatively insignificant (less than 6 psi) with 1.5 M sugar/DI water and 1.5 M KCl/DI water systems due to the inefficiency of the membranes (i.e., $\sigma_o\approx0$). In addition, pressure oscillations were observed with the sugar solutions. These oscillations may be due to the influence of osmosis, hydration/cake degradation, and cake recrosslinking. Thus, typical guar/borate filter cakes are not effective semi-permeable membranes.

The effectiveness of the membranes required an initial membrane drying procedure which may have made the membranes semi-permeable by reducing the pore size (size exclusion and, subsequently, liquid flow) or evaporating the solvent within the pores (allowing vapor transport). The mechanism of size exclusion is not likely for salt solutions so, in the absence of electrostatic repulsion, the effectiveness of polysaccharide based membranes suggests an internal vapor phase transport mechanism. Unfortunately, a drying procedure would not be feasible in a reservoir so alternative methods of making guar/borate filter cakes semi-permeable must be investigated. The most obvious method of limiting solute transport through filter cakes would be to add charged components, such as silicates, to the polymer solution in order to promote electrostatic repulsion.

Conclusions

1. An osmotic pressure of 150 psi was observed in the cylindrical osmotic cell with a 1.5 M sugar/dialysis membrane/DI water system. The theoretical osmotic pressure is approximately 1100 psi. The discrepancy is due to leaks in the system and possibly limitations of the membrane ($\sigma_o$<1)

2. An osmotic pressure of 20 psi was observed in the linear osmotic cell with a 1.5 M sugar/dialysis membrane/DI water system. Results are consistent with the maximum pressure being limited by dehydration of the membrane due to a decrease in water saturation in the porous medium.

3. The observed volume flux of about 0.025 cm/hr during the flow of water through the membrane and into the porous medium is consistent with an effective membrane permeability of about $6\times10^{-6}$ md. This volume flux is not due to D'Arcy flow. Thus, this observed volume flux parameter will be input into the computer simulator to model fracture clean-up in accordance with the present Invention.

4. Pressure changes with guar/borate filter cakes were relatively insignificant (less than 6 psi) with 1.5 M sugar/DI water and 1.5 M KCl/DI water systems. Thus, conventional guar/borate filter cakes are not effective semi-permeable membranes.

5. Pressure oscillations were observed with 1.5 M sugar/(guar/borate filter cake)/DI water systems in cylindrical and linear osmotic cells. These oscillations may be due to the influence of osmosis, hydration/cake degradation, and cake recrosslinking.

6. Linear guar polymer (WF160) does not act as an osmotic fluid (because the activity is not significantly different from that of pure water). Thus, the presence of uncrosslinked or broken polymer in the fracture should not significantly affect any osmotic processes, provided the membrane integrity was not deteriorated.

EXAMPLE 2

Modeling Fracturing Fluid Movement in a Subsurface Environment

Again, the purpose of the previous Example was to obtain an experimental (i.e., laboratory-derived) value to describe osmotic flow in order to model flow from that source in a simulated subsurface environment. The purpose of this Example is to present the results from a study designed to assess whether the method and composition of the present Invention is effective in moving fracturing fluid from a fracture tip into the adjacent formation.

Modeling Protocol—the Inputs and Equations

To ensure that the results from the computer simulation mimic as closely as possible, real-world conditions, the parameter used to describe osmotic flow (Jv, the volume flux due to osmotically induced flow)—the key parameter in the model—was obtained by laboratory experiment, according to Example 1. Put more simply, the study presented in this Example purports to answer the following question: having determined an experimentally based value for the osmotic flux, is this flux significant enough to actually move appreciable volumes of fluid from a subsurface fracture tip? Or: can the present Invention be employed to actually clean-up a fracture?

Thus, in the model described in this Example, the hydraulic (or D'Arcy) flow is set to zero—therefore any flow of the fracturing fluid held in the fracture must be due to osmotic flow.

Figure 3:
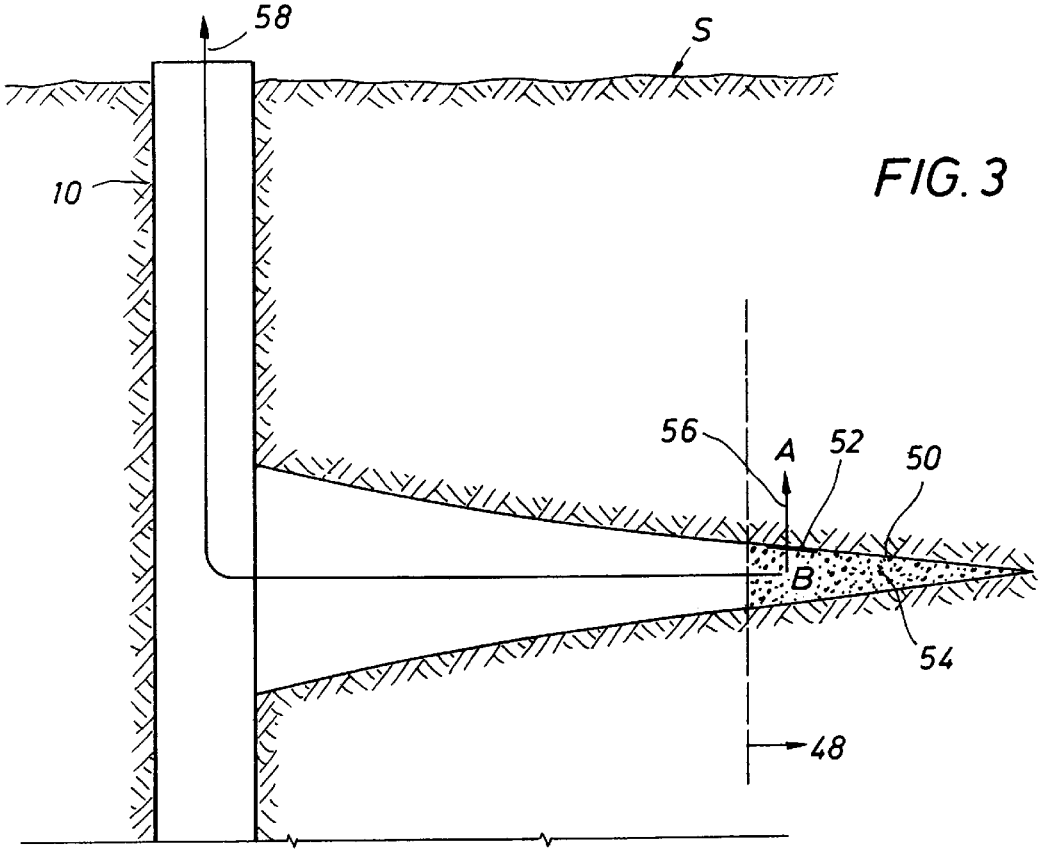
FIG. 3 depicts a cross-sectional view of a stylized fracture modified to show certain essential features of the present Invention.

Referring again to FIG. 3, the fracture tip, 48—i.e., the distal portion of the fracture hydraulically isolated from the remainder of the fracture and thus retaining stagnant fracturing fluid that prevents the flow of hydrocarbon through that portion of the fracture—is the portion of the fracture from which it is desired to remove fluid.

The constant parameters input into the computer simulation are: fracture height (100 ft.), length (1000 ft.), fracture vertical width (0.2 in.). Each of the values mimics real-world values. The left-most column of Table 2 recites different intervals of the total fracture length in 50 ft intervals—from 0 (at the wellbore) to 1000 ft., the distal-most portion of the fracture. Thus, the entire fracture is, in this computer simulation, discretized into 50 ft. cells. The next column gives the fracture width side-to-side (this is assumed to diminish with increasing distance from the wellbore). The next two columns are calculated from the following equations:

$$V=\text{del}x*h*W_{ave}$$

where del x is the length of the differential fracture portion (in these calculations always equal to 50 ft.), $w_{ave}$ is the average width over the length of that portion of the fracture, and h is the fracture height. "V" represents the volume of fluid removed from that 50 ft. portion of the fracture—the total volume is shown at the bottom of each column. The rows from 650 ft.–1000 ft are intended to represent the fracture tip—i.e., that portion of the fracture from which it is difficult to remove the fracture fluid, due to the distance from the wellbore and due to the hydraulic isolation of that portion of the fracture. Thus, the numbers inside the box are intended to indicate the efficacy of the present Invention in removing fluid from the fracture tip. The final column displays the time that it takes to remove the fluid in that portion of the fracture to the immediate left (assuming this entire fracture volume were completely filled with fluid).

In a separate set of experiments, plausible rates for diffusion were determined by conventional laboratory methods. The purpose of this experiment was to verify that diffusion would occur quickly enough relative to the osmotic flow rate—in a typically subsurface environment. If solute diffusion occurs too slowly, then a solute—depleted region will occur near the interface—this local gradient near the interface is far less than the overall gradient beyond the region immediately adjacent to the interface. Experiments performed in connection with this Application have determined that in fact, diffusion is much faster than osmotic flow, and therefore at the solute gradient is quickly reestablished or replenished at the interface as the solute concentration is depleted by the transfer of water from the fracture.

Results and Discussion

Thus, at the fracture cell 650–700 ft., 1309 liters of fluid was removed in 5.51 hours. The time is calculated using the following equation:

$$t=V/Q=V/(2*Ac'*\text{sigma}*Jv)=V/(2*\text{del}x*h*\text{sigma}*Jv)$$

Jv is the volume flux—i.e., that parameter obtained from the laboratory experiments in Example 1 above, and sigma reflects the membrane efficiency (assumed to be unity in this study).

Also, according to Table 2, it took 0.82 hrs to remove all of the fluid remaining in the distal-most tip of the fracture (950–1000 ft.). Again, this number represents the migration of fracturing fluid from the fracture tip into the adjacent formation—and this fluid movement is due solely to an osmotic gradient, since the other flow term, hydraulic flow, is set to zero. Therefore, the data presented in Table 2 unquestionably demonstrates to one skilled in the art that osmotic flow is a significant source of the total flow in a subsurface fracture environment—as evidenced by the fact that, for instance, the last 100 ft. of the fracture was cleaned-up—i.e., the stagnant fracturing fluid was completely removed fracturing fluid from the fracture into the formation by osmotic flow—in about 2 hours. To one skilled in the art, this number is significant since fracture clean-up can take days, or weeks, and the fluid in the tip is still not removed. Thus, the present Invention is a viable system for removing stagnant fracturing fluid from the subsurface fracture.

TABLE 2

| | x [ft] | w [in] | V [mL] | t [hr] |
|---|---|---|---|---|
| well | 0 | 0.200 | | — |
| | 50 | 0.194 | 2323991 | 9.79 |
| | 100 | 0.188 | 2251713 | 9.48 |
| | 150 | 0.181 | 2177852 | 9.17 |
| | 200 | 0.175 | 2102280 | 8.85 |
| | 250 | 0.168 | 2024850 | 8.53 |
| | 300 | 0.161 | 1945391 | 8.19 |
| | 350 | 0.154 | 1853703 | 7.85 |
| | 400 | 0.147 | 1779552 | 7.50 |
| | 450 | 0.140 | 1692654 | 7.13 |
| | 500 | 0.132 | 1602667 | 6.75 |
| | 550 | 0.124 | 1509168 | 6.36 |
| | 600 | 0.115 | 1411623 | 5.95 |
| | 650 | 0.107 | 1309341 | 5.51 |
| | 700 | 0.097 | 1201398 | 5.06 |
| | 750 | 0.087 | 1086510 | 4.58 |
| | 800 | 0.076 | 962785.2 | 4.06 |
| | 850 | 0.064 | 827213.8 | 3.48 |
| | 900 | 0.050 | 674370.3 | 2.84 |
| | 950 | 0.033 | 491903.3 | 2.07 |
| tip | 1000 | 0.000 | 195538 | 0.82 |
| | | | 29434502 | 6.20 |

The efficacy and reliability of the method and composition of the resent Invention must be verifiable by the on-site petroleum engineer and other on-site personnel skilled in well stimulation. Indeed, this is easily accomplished by several means. For instance, the present Invention will result in increased fluid removal from the fracture, and therefore, increased effective fracture length. Thus conventional techniques used to measure effective fracture length can be employed to assess the efficacy of the method and composition of the present Invention. Such methods include pressure transient analysis. The effective fracture length than then be compared with the actual fracture length determined by standard fracture geometry models.

Finally, the skilled petroleum engineer, upon reading the present Application, will likely recognize that a natural solute concentration gradient may exist between the formation pore fluids and the aqueous phase of the fracturing fluid resident in the fracture, and that many fluid-loss additives (for instance) are capable of creating, intrinsically, a selectively-permeable membrane, at least nominally. Yet assuming such a gradient does exist, then it is very likely to be too small to exploit—i.e., to transfer sufficient quantities of fluid into the formation surrounding the fracture. This is because the pad fluid (the fluid used to create the fracture, thus the fluid first introduced into the fracture) is more or less isotonic to the proppant-delivery fluid (indeed, it is often identical). Moreover, the vast majority of the oil-bearing formations are sandstone or limestone systems-systems whose pore fluids are not sufficiently solute rich to give rise to a concentration gradient sufficient to transfer appreciable levels of fluid into the formation.

The preceding discussion was intended to describe several preferred embodiments of the present Invention. The skilled artisan will no doubt realize that various modifications to the method sand compositions described above may be effected without departing from the basic concepts and principles of the present Invention. Thus, changes of this type are deemed to lie within the spirit and scope of the invention; the present Invention is limited only by the claims that follow.

What is claimed is:

1. A system for stimulating hydrocarbon production of well in fluid engagement with a hydrocarbon-bearing subterranean formation by creating a fracture in said formation comprising:

a fracture-inducing fluid containing a concentration of solute greater than the concentration of the fluid remaining in the fracture after treatment;

a membrane-forming material in an amount sufficient to form a membrane;

a proppant-delivery fluid having an aqueous phase having a solute concentration less than the solute concentration in the formation after fluid leak-off.

2. The system of claim 1 wherein said material is selected from the group consisting of hydroxy compounds, polyhydroxy compounds, galactomannans crosslinked with boric acid, cellulose acetate, silicates, and copper hexacyanoferrate.

3. The system of claim 1 wherein said solute is comprised of an anion selected from the group consisting of Cl, $NO_3$, $NO_2$, and $SO_4$.

4. The system of claim 1 wherein said membrane-forming material is comprised of one or more polyhyrdoxy compounds.

5. The system of claim 1 wherein said membrane-forming material is polyethylene glycol.

6. The system of claim 1 wherein said delivery fluid further comprises a viscoelastic surfactant.

7. A non-hydraulic system for removing spent fracturing fluid from a subsurface fracture, prepared by the process comprising the steps of:

injecting into a wellbore in fluid communication with a hydrocarbon-bearing formation, a fracturing-inducing fluid, said fluid containing a concentration of solute greater than the fluid remaining in the fracture after treatment; thereafter, injecting into said fracture through said wellbore, a membrane-forming material; thereafter, injecting into said fracture through said wellbore, a proppant-delivery fluid having an aqueous phase having a solute concentration less than the solute concentration in the formation after fluid leak-off.

8. The system of claim 7 wherein said material is selected from the group consisting of hydroxy compounds, polyhdroxy compounds, galactomannans cross-linked with boric acid, cellulose acetate, silicates, and copper hexacyanoferrate.

9. The system of claim 7 wherein said solute is comprised of an anion selected from the group consisting of $Cl^-$, $NO_3^-$, $NO_2^-$, and $SO_4$.

10. The system of claim 7 wherein said membrane-forming material is comprised of one or more polyhydroxy compounds.

11. The system of claim 7 wherein said membrane-forming material is polyethylene glycol.

* * * * *